US010071753B2

(12) United States Patent
Liang et al.

(10) Patent No.: US 10,071,753 B2
(45) Date of Patent: Sep. 11, 2018

(54) RAILWAY VEHICLE AND CHASSIS END PLATE ASSEMBLY THEREOF

(71) Applicant: CRRC QINGDAO SIFANG CO., LTD., Qingdao, Shandong (CN)

(72) Inventors: Jianying Liang, Shandong (CN); Pengfei Liu, Shandong (CN); Yanchao Liu, Shandong (CN); Xianliang Sun, Shandong (CN); Jichun Li, Shandong (CN); Yonggui Zhang, Shandong (CN); Fujun Kou, Shandong (CN); Qinglin Lin, Shandong (CN); Sansan Ding, Shandong (CN); Aiqin Tian, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 342 days.

(21) Appl. No.: 15/106,273

(22) PCT Filed: Nov. 13, 2015

(86) PCT No.: PCT/CN2015/094562
§ 371 (c)(1),
(2) Date: Jun. 17, 2016

(87) PCT Pub. No.: WO2016/141730
PCT Pub. Date: Sep. 15, 2016

(65) Prior Publication Data

US 2018/0178818 A1 Jun. 28, 2018

(30) Foreign Application Priority Data

Mar. 12, 2015 (CN) ..... 2015 1 0108420
Mar. 12, 2015 (CN) ..... 2015 2 0141427 U

(51) Int. Cl.
*B61F 1/10* (2006.01)
*B61F 1/00* (2006.01)
(Continued)

(52) U.S. Cl.
CPC ..... *B61F 1/10* (2013.01); *B61D 15/06* (2013.01); *B61D 17/04* (2013.01); *B61F 1/00* (2013.01); *B61F 1/14* (2013.01)

(58) Field of Classification Search
CPC ..... B61F 1/10; B61F 1/14; B61F 1/00; B61D 15/06; B61D 17/04
See application file for complete search history.

(56) References Cited

U.S. PATENT DOCUMENTS 4,782,762 A * 11/1988 Johnstone ..... B61F 1/10 105/355
9,290,188 B2 * 3/2016 Schwiegel ..... B61F 1/10
(Continued)

FOREIGN PATENT DOCUMENTS

CN 201516856 U 6/2010
CN 201998993 U 10/2011
(Continued)

OTHER PUBLICATIONS

First Office Action for CN201510108420.6, dated Aug. 29, 2016.
International Search Report for PCT/CN2015/094562, dated Feb. 2, 2016, ISA/CN.

*Primary Examiner* — Jason C Smith
(74) *Attorney, Agent, or Firm* — U.S. Fairsky LLP; Yue (Robert) Xu

(57) ABSTRACT

A chassis end plate assembly of a railway vehicle is provided, which includes an end plate; a bottom beam arranged at an inner side of a lower edge of the end plate, curved beams arranged at inner sides of two sides of the end plate, a buffer beam located above the end plate; and a reinforcing beam longitudinally arranged between the buffer beam and
(Continued)

the bottom beam. The end plate assembly can increase the rigidity of an end portion of the vehicle and improve the vibration mode. The end plate assembly can be combined with an under-vehicle active device compartment so as to form an enclosed space, which may protect pipelines and devices under the vehicle. A railway vehicle provided with the chassis end plate assembly is further provided.

10 Claims, 5 Drawing Sheets

(51) Int. Cl.

| | |
|---|---|
| ***B61D 15/06*** | (2006.01) |
| ***B61D 17/04*** | (2006.01) |
| ***B61F 1/14*** | (2006.01) |

(56) References Cited

U.S. PATENT DOCUMENTS

| | | | | |
|---|---|---|---|---|
| 2013/0098264 | A1* | 4/2013 | Kuroda | B61D 15/06 105/392.5 |
| 2013/0319281 | A1* | 12/2013 | Schwiegel | B61F 1/10 105/396 |
| 2018/0178818 | * | 6/2018 | Liang | B61F 1/10 |

FOREIGN PATENT DOCUMENTS

| | | | |
|---|---|---|---|
| CN | 102514583 | A | 6/2012 |
| CN | 202806776 | U | 3/2013 |
| CN | 103625500 | A | 3/2014 |
| CN | 104724133 | A | 6/2015 |
| CN | 204548140 | U | 8/2015 |
| JP | 2003054405 | A | 2/2003 |

* cited by examiner

RAILWAY VEHICLE AND CHASSIS END PLATE ASSEMBLY THEREOF

This application is the national phase of International Application No. PCT/CN2015/094562, titled "RAILWAY VEHICLE AND CHASSIS END PLATE ASSEMBLY THEREOF", filed on Nov. 13, 2015, which claims the benefit of priorities to Chinese Patent Application No. 201510108420.6 titled "RAILWAY VEHICLE AND CHASSIS END PLATE ASSEMBLY THEREOF", filed with the Chinese State Intellectual Property Office on Mar., 12, 2015, and Chinese Patent Application No. 201520141427.3 titled "RAILWAY VEHICLE AND CHASSIS END PLATE ASSEMBLY THEREOF", filed with the Chinese State Intellectual Property Office on Mar., 12, 2015, the entire disclosures of which applications are incorporated herein by reference.

FIELD

The present application relates to the technical field of railway vehicles, and particularly to a chassis end plate of a railway vehicle. The present application further relates to a railway vehicle provided with the end plate.

BACKGROUND

An under-vehicle active device compartment of a railway vehicle has a same outline as a cross section of a vehicle body. A bottom of the vehicle body is smooth, which includes a bottom plate, an end plate, a skirt plate, a framework and a snow guard plate, etc. The bottom plate is mounted under the device compartment. The skirt plate is mounted at a lateral side of the device compartment. The end plate is mounted at an end portion of the device compartment. The snow guard plate is mounted on an upper portion of a bogie. An integrated framework is formed taken the framework, a lower side beam of the vehicle body and under-vehicle devices as a mounting base.

A utility model patent CN 202806776U discloses a chassis partition and a motor train unit, in which the chassis partition is namely the end plate of the under-vehicle active device compartment. The partition is formed as an integral structure and includes a supporting frame of a plate type frame structure. A supporting plate is fixedly connected to a side of the supporting frame and has an outline matching with the shape of an end face of the device compartment of the motor train unit.

Although the end plate in such form has a simple structure, is easy to manufacture, and can bear air load applied when the motor train unit travels at a high speed, the end plate assembly, as one of main force bearing components, of the high-speed railway vehicle, has a reliability directly related to the overall strength of the vehicle body and operational safety, thus the partition is unable to meet the requirements to an end plate assembly by the high-speed railway vehicle.

Therefore, a technical issue to be addressed by those skilled in the field is to design a chassis end plate assembly adapted to the high-speed railway vehicle.

SUMMARY

A first object of the present application is to provide a chassis end plate assembly of a railway vehicle. The end plate assembly can increase the rigidity of end portions of the vehicle and improve a vibration mode. The end plate assembly can be combined with an under-vehicle active device compartment to form an enclosed space, which may protect pipelines and devices under the vehicle, thus is particularly adapted to the high-speed railway vehicle.

A second object of the present application is to provide a railway vehicle having the chassis end plate assembly.

To achieve the above objects, a chassis end plate assembly of a railway vehicle is provided according to the present application, which includes:

an end plate, which is a hollow profile with double layers and has the same outline as a cross-section of an under-vehicle active device compartment;

a bottom beam arranged at an inner side of a lower edge of the end plate;

curved beams, which are arranged at inner sides of two side of the end plate respectively;

a buffer beam located above the end plate, wherein outer surfaces of the buffer beam and the end plate are located in the same plane, the buffer beam has a left half part and a right half part which are left-right symmetric, and between the left and right half parts, a U-shaped groove for accommodating a coupler is formed, vehicle-end damper mounting grooves opening outwards are formed on two sides of the buffer beam, and the left half part and the right half part are each provided with a mounting hole configured to allow pipelines or wirings to pass through; and a reinforcing beam longitudinally arranged between the buffer beam and the bottom beam.

Preferably, each of the curved beams includes a first curved beam and a second curved beam, the first curved beam is located at an inner side of an arc edge of the end plate, and the first curved beam is transitionally connected to the bottom beam via the second curved beam.

Preferably, the chassis end plate assembly of the railway vehicle further includes a lining plate circumferentially arranged at inner sides of the bottom beam, the curved beams and the buffer beam.

Preferably, an upper edge of the buffer beam is bent inward by 90 degrees and then is continuously bent downward and inward by 90 degrees, which forms a Z shape; and a lower edge of the buffer beam is bent inward by 90 degrees.

Preferably, horizontal wing plates parallel to each other are arranged between the upper edge and the lower edge of the buffer beam; each of the wing plates includes a first wing plate and a second wing plate, the first wing plate is located in the same plane as an upper edge of the vehicle-end damper mounting groove, the second wing plate is located below the first wing plate and is shorter and narrower than the first wing plate; and the second wing plates of the wing plates are located at two sides of the U-shaped groove respectively.

Preferably, a longitudinal wing plate is arranged on the top of the buffer beam.

Preferably, the mounting hole includes a first mounting hole located above the first wing plate, and a second mounting hole and a third mounting hole which are both located below the first wing plate and at an outer side of the second wing plate.

Preferably, the end plate and the buffer beam are each provided with an inner windshield mounting interface, and the end plate is further provided with an outer windshield mounting interface.

Preferably, the bottom beam and the curved beam are hollow rectangular profiles, and on a side of each of the bottom beam and the curved beam abutting against the under-vehicle active device compartment, a vertical edge deflecting toward an inside of a vehicle body is provided.

To achieve the above second object, a railway vehicle is provided according to the present application, which includes a vehicle body and a bogie, an under-vehicle active device compartment of the vehicle body is provided with the chassis end plate assembly of the railway vehicle according to any of above descriptions, and a part below the buffer beam of the end plate assembly is combined with the under-vehicle active device compartment to form an enclosed space.

The end plate assembly according to the present application includes the hollow profile, the reinforcing beam, the bottom beam, the curved beam, the buffer beam and the like. The hollow profiles are welded together to form a middle part of the end plate assembly, which is then welded with the reinforcing beam, the bottom beam and the curved beam, so as to form the end plate assembly, and is finally welded with the buffer beam of the vehicle. The end plate assembly includes the buffer beam, which can integrate the inner and outer windshields mounting interfaces, and interfaces for various pipelines of the vehicle end, a sewage tank, a vehicle end buffer seat. The profiles adopted by circumferential beams and the curved beams are provided with mounting interfaces for the active device compartment. After the end plate assembly is mounted, the rigidity of the end portion of the vehicle is strengthened, and the vibration mode is improved. The buffer beam provides an annular encasing place for the coupler, thus having a better protection effect. The part below the buffer beam can be combined with the under-vehicle active device compartment to form an enclosed space in order to protect pipelines and device under the vehicle, thus is particularly applicable to a high-speed vehicle made of aluminum alloy.

The railway vehicle according to the present application is provided with the above mentioned chassis end plate assembly of the railway vehicle. Since the chassis end plate assembly of the railway vehicle has the above technical effects, the railway vehicle provided with the chassis end plate assembly of the railway vehicle also has the corresponding technical effects.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for those skilled in the art, other drawings may be obtained based on these drawings without any creative efforts.

FIG. 6 is a schematic view showing the chassis end plate assembly of the railway vehicle according to the present application which is provided with an outer windshield mounting interface and pipelines and wirings passing through.

Figure 1:
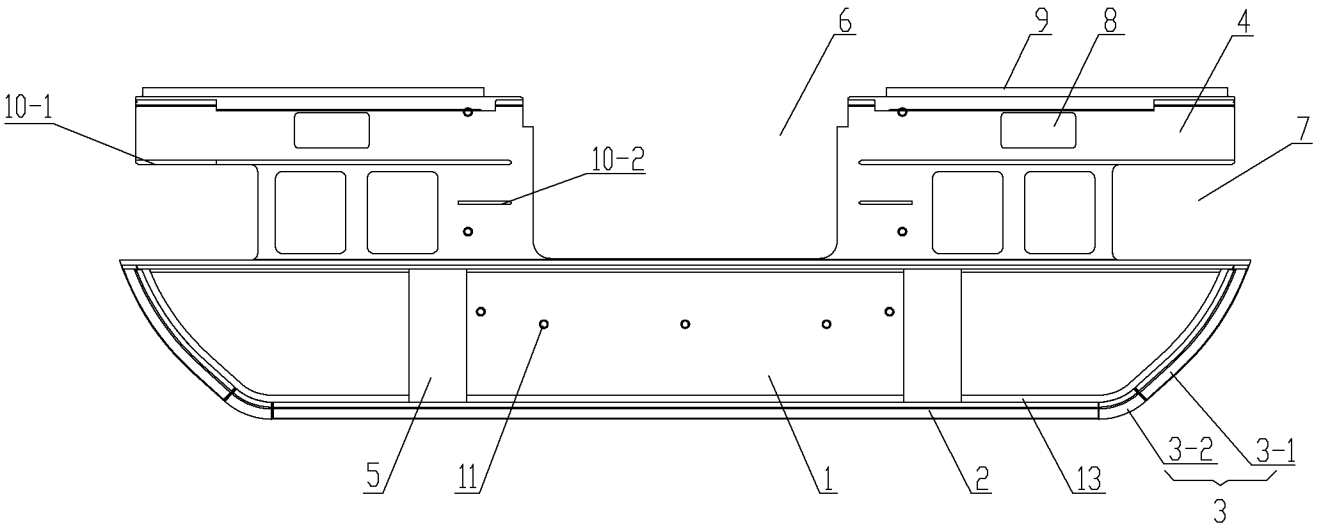
FIG. 1 is a schematic front view of an inner side of a chassis end plate assembly of a railway vehicle according to the present application.

Reference numerals in Figures:

| | | | |
|---|---|---|---|
| 1 | end plate, | 2 | bottom beam, |
| 3 | curved beam, | 3-1 | first curved beam, |
| 3-2 | second curved beam, | 4 | buffer beam, |
| 5 | reinforcing beam, | 6 | U-shaped groove, |
| 7 | vehicle-end damper mounting groove, | 8 | mounting hole, |
| 9 | longitudinal wing plate, | 10-1 | first wing plate, |
| 10-2 | second wing plate, | 11 | inner windshield mounting interface, |
| 12 | outer windshield mounting interface, | 13 | lining plate, |
| 14 | vertical edge, | 15 | recessed portion, |
| 16 | bolt assembly, | 17 | bottom plate, |
| 18 | side plate, | 19 | sealing rubber strip, |
| 20 | strip mounting member, and | 21 | pipeline and wiring. |

DETAILED DESCRIPTION

For the purpose, technical solution and the advantages of the present application to be clearer, technical solutions in the embodiments of the present application will be clearly and fully described hereinafter in conjunction with accompanying drawings in the embodiments of the present application. Apparently, the described embodiments are only a part, rather than all, of the embodiments of the present application. All other embodiments obtained by those ordinary skilled in the art based on the embodiments of the present application without making any creative efforts fall within the protection scope of the present application.

Herein, terms such as "above", "below", "inner", "outer" and the like are defined based on the position relationship shown in Figures. The position relationships may vary according to the corresponding figures and thus are not to be construed as an absolute limit to the scope of protection of the present application.

Figure 2:
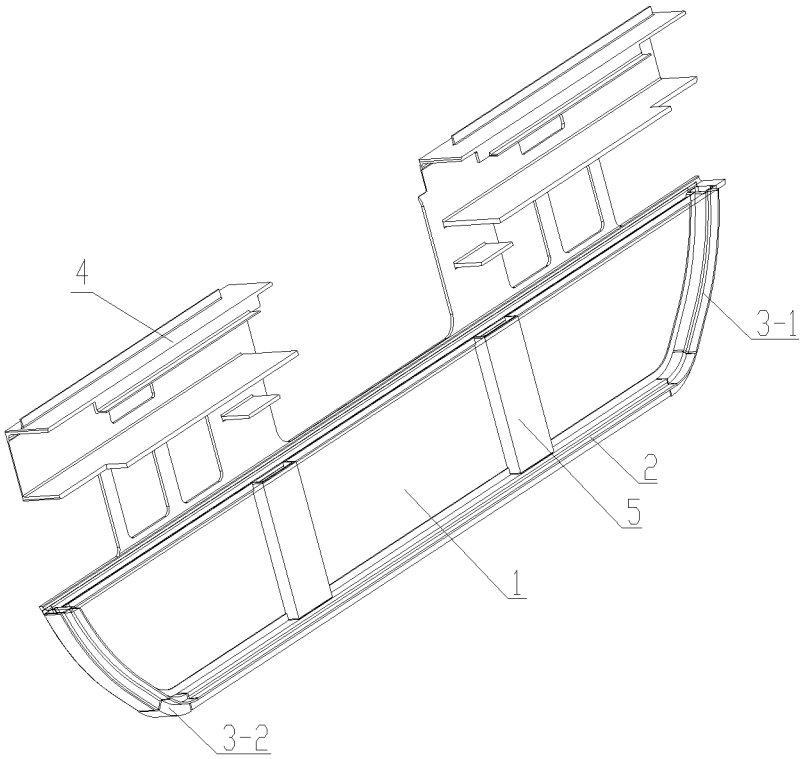
FIG. 2 is a perspective view of the chassis end plate assembly of the railway vehicle according to the present application.
Figure 3:
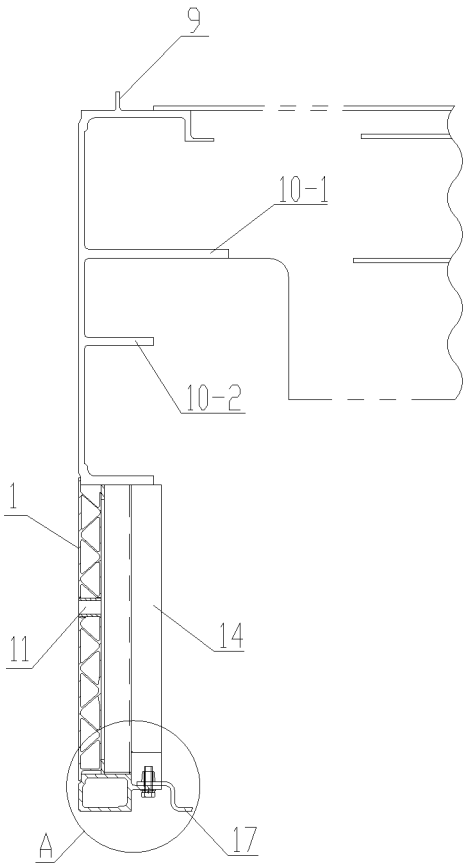
FIG. 3 is a sectional view of the chassis end plate assembly of the railway vehicle according to the present application.

Referring to FIGS. 1, 2 and 3, FIG. 1 is a schematic front view of an inner side of a chassis end plate assembly of a railway vehicle according to the present application; FIG. 2 is a perspective view of the chassis end plate assembly of the railway vehicle according to the present application; and FIG. 3 is a sectional view of the chassis end plate assembly of the railway vehicle according to the present application.

In a specific embodiment, the chassis end plate assembly of the railway vehicle according to the present application is generally formed by assembling and welding an end plate 1, a bottom beam 2, a curved beam 3, a buffer beam 4, a reinforcing beam 5 and the like.

The end plate 1 is a hollow profile with double layers. The end plate 1 has the same outline as a cross section of an under-vehicle active device compartment. A top portion and a bottom portion of the end plate 1 are straight edges parallel to each other. The bottom portion is shorter than the top portion. Arc edges at two sides of the end plate 1 smoothly transit from the top portion to the bottom portion, thereby substantially forming a boat-like shape.

The bottom beam 2 is located at an inner side of a lower edge of the end plate 1. The curved beams 3 are located an inner side of two sides of the end plate 1. Each of the curved beams 3 includes a first curved beam 3-1 and a second curved beam 3-2. The first curved beams 3-1 are located at inner sides of the two arc edges of the end plate 1. The first curved beams 3-1 are transitionally connected to the bottom beam 2 via the second curved beams 3-2.

The buffer beam 4 is located at an upper side of the end plate 1 and located in the same plane as an outer surface of the end plate 1. The buffer beam 4 includes a left half part and a right half part which are left-right symmetric, and is substantially of a "π" shape. A U-shaped groove 6 configured to accommodate a coupler is provided in the middle of the buffer beam 4, and an annular encasing space is formed for the coupler, thus achieving a better protection. Vehicle-end buffer mounting grooves 7 each having an outward opening are arranged at two sides of the buffer beam 4. The left half part and the right half part are each provided with a mounting hole 8 configured to allow pipelines and wirings to pass through.

A lower edge of the buffer beam 4 is bent inward by 90 degrees. An upper edge of the buffer beam 4 is bent inward by 90 degrees and then is partially continuously bent inward and downward by 90 degrees, thereby forming a Z shape. A longitudinal wing plate 9 with a small height is arranged on a top of the bent portion of the buffer beam 4.

Two horizontal wing plates parallel to each other are arranged between the upper edge and the lower edge of the buffer beam 4, and the two horizontal wing plates are respectively a first wing plate 10-1 and a second wing plate 10-2. The first wing plate 10-1 is located in the same plane as an upper edge of the corresponding vehicle-end buffer mounting groove 7; and the second wing plate 10-2 is located below the first wing plate 10-1, and is shorter and narrower than the first wing plate 10-1. The second wing plates 10-2 are located at two sides of the U-shaped groove 6 respectively.

Multiple rectangular mounting holes 8 are provided in the buffer beam 4, which are respectively a first mounting hole above the first wing plate 10-1, and a second mounting hole and a third mounting hole both located below the first wing plate 10-1 and at an outer side of the second wing plate 10-2. Each of the mounting holes is configured to allow pipelines and wirings 21 from different parts to pass through respectively, and the mounting holes are sealed after mounting. Modularization is taken into consideration in designing the buffer beam 4, and vehicle-end holes are coincident in size and position and thus sealing parts are also of the same size.

The end plate 1 and the buffer beam 4 are each provided with inner windshield mounting interfaces 11 along edges of an inner windshield (not shown). A number of the mounting interfaces provided in the end plate 1 is five, and the five mounting interfaces are provided at positions corresponding to a lower edge of the inner windshield. A number of the mounting interfaces provided in the buffer beam 4 is four, and the four mounting interfaces are provided at positions corresponding to a lower portion of two sides of the inner windshield.

Figure 6:
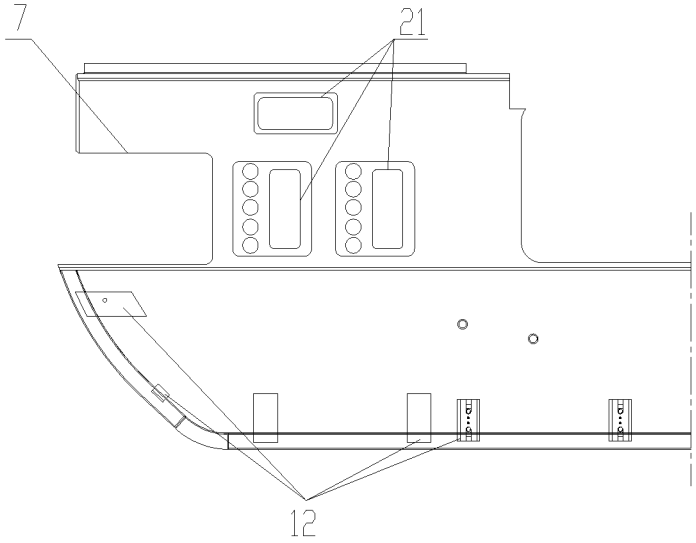

Moreover, a periphery of the end plate 1 is further provided with outer windshield mounting interfaces 12 (see FIG. 6) at positions corresponding to an entire bottom part of an outer windshield, thus facilitating the installation of the outer windshield.

For further improving the structural strength of the end plate 1, an inner side of the end plate 1 is further provided with two longitudinal reinforcing beams 5. The reinforcing beams 5 are welded between the buffer beam 4 and the bottom beam 2 and longitudinally spaced apart from each other, and since the reinforcing beams 5 are located outside of the inner windshield, the installation of the inner windshield may not be adversely affected.

Furthermore, a lining plate 13 having the same outline as the end plate 1 is arranged along the periphery of the end plate 1 at inner sides of the bottom beam 2, the curved beams 3 and the buffer beam 4.

Figure 4:
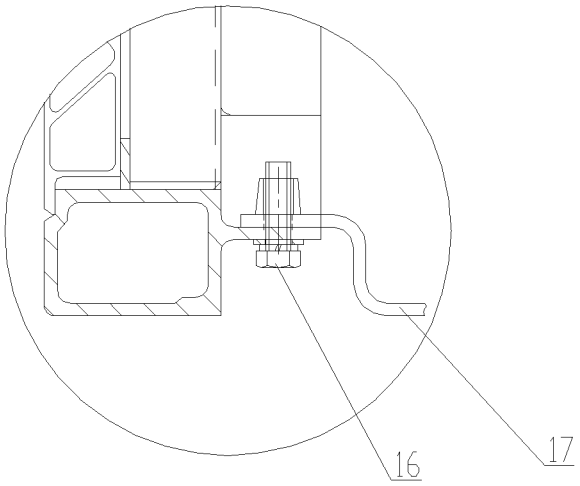
FIG. 4 is a partial enlarged view of part A in FIG. 3.
Figure 5:
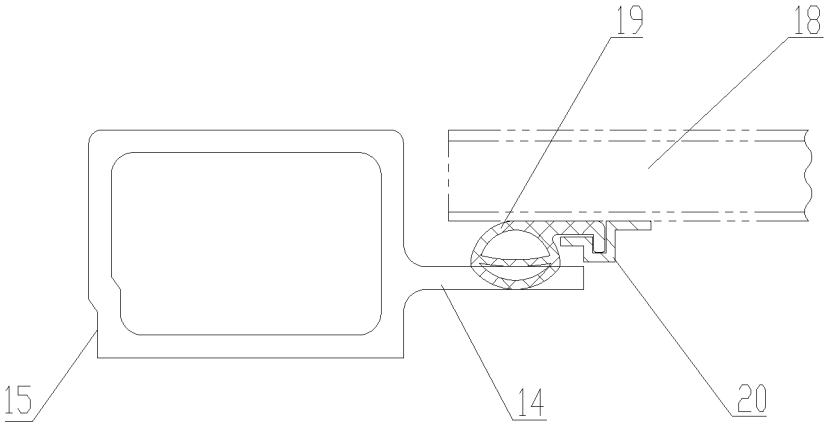
FIG. 5 is a schematic view showing cooperation of a curved beam and an under-vehicle active device compartment.

Referring to FIGS. 4 and 5, FIG. 4 is a partial enlarged view showing part A in FIG. 3; and FIG. 5 is a schematic view showing cooperation of a curved beam and an under-vehicle active device compartment.

As shown, the bottom beam 2 and the curved beam 3 are both hollow rectangular profiles, on a side of each of the bottom beam and the curved beam abutting against the under-vehicle active device compartment, a vertical edge 14 deflecting towards the inside of the vehicle body is provided, and at a corner where each of the bottom beam and the curved beam abuts against the end plate 1, a recessed portion 15 is provided.

The vertical edge 14 of the bottom beam 2 is connected to a bottom plate 17 of the under-vehicle active device compartment through a bolt assembly 16. A sealing rubber strip 19 is arranged between the vertical edge 14 of the curved beam 3 and a side plate 18 of the under-vehicle active device compartment.

The sealing rubber strip 19 is substantially of a "9" shape, with a separating rib provided inside an annular portion of the "9" shape. A hook shaped tail of the sealing rubber strip 19 is embedded into a "几" shaped strip mounting member 20 on an inner wall of the side plate 18. One side bent by 90 degrees of the strip mounting member 20 is connected to the side plate 18, and another side bent by 90 degrees of the strip mounting member 20 is kept a certain distance from the side plate 18, in order to form a slot into which the tail portion of the sealing rubber strip 19 can be embedded. After installation, a head portion of the sealing rubber strip 19 is elastically deformed under the compression of, the vertical edge 14 of the curved beam 3 and the side plate 18, thus achieving a sealing function.

The end plate 1 is a hollow profile with double layers, and the bottom beam 2 and the curved beams 3 of the hollow profile are welded around the end plate 1, thereby increasing the rigidity of an end portion of the vehicle and improving a vibration mode.

The above descried embodiments are only preferable embodiments of the present application and should not be regarded as a limitation to the present application. On basis of this, many targeted modifications can be made according to actual requirements, thus obtaining various embodiments. For example, the buffer beam can be designed in other shapes; or the position and number of the mounting holes can be adjusted as desired, etc. Many implementations may be adopted, which are not described in further detail hereinafter.

In addition to the above mentioned chassis end plate assembly of the railway vehicle, a railway vehicle is further provided according to the present application, which includes a vehicle body and a bogie. An under-vehicle active device compartment of the vehicle body is provided with the above mentioned chassis end plate assembly of the railway vehicle. A part below a buffer beam of the end plate assembly and the under-vehicle active device compartment are combined to form an enclosed space in order to protect pipelines and devices below the vehicle. The structure of other part can be referred to the prior art, which will not be described herein.

The railway vehicle and the chassis end plate assembly thereof according to the present application are described in detail hereinbefore. The principle and the embodiments of the present application are illustrated herein by specific examples. The above description of examples is only intended to help the understanding of the core concept of the present application. It should be noted that, for those skilled in the art, a few of modifications and improvements may be made to the present application without departing from the principle of the present application, and these modifications and improvements are also deemed to fall into the scope of the present application defined by the claims.

What is claimed is:

1. A chassis end plate assembly of a railway vehicle, comprising:

an end plate, which is a hollow profile with double layers and has the same outline as a cross-section of an under-vehicle active device compartment;

a bottom beam arranged at an inner side of a lower edge of the end plate;

curved beams arranged at inner sides of two sides of the end plate respectively;

a buffer beam located above the end plate; and a reinforcing beam longitudinally arranged between the buffer beam and the bottom beam;

wherein outer surfaces of the buffer beam and the end plate are located in the same plane, the buffer beam has a left half part and a right half part which are left-right symmetric, and between the two half parts, a U-shaped groove configured to accommodate a coupler is provided, vehicle-end damper mounting grooves having outward openings are provided at two sides of the buffer beam, and the left half part and the right half part are each provided with a mounting hole configured to allow pipelines or wirings to pass through.

2. The chassis end plate assembly of a railway vehicle according to claim 1, wherein each of the curved beams comprises a first curved beam and a second curved beam, the first curved beam is located at an inner side of an arc edge of the end plate, and the first curved beam is transitionally connected to the bottom beam via the second curved beam.

3. The chassis end plate assembly of a railway vehicle according to claim 1, further comprising a lining plate circumferentially arranged at inner sides, of the bottom beam, the curved beams and the buffer beam.

4. The chassis end plate assembly of a railway vehicle according to claim 1, wherein an upper edge of the buffer beam is bent inward by 90 degrees and then is continuously bent downward and inward by 90 degrees, and forms a Z shape; and a lower edge of the buffer beam is bent inward by 90 degrees.

5. The chassis end plate assembly of a railway vehicle according to claim 4, wherein horizontal wing plates parallel to each other are provided between the upper edge and the lower edge of the buffer beam; each of the wing plates comprises a first wing plate and a second wing plate, the first wing plate is located in the same plane as an upper edge of the vehicle-end damper mounting groove, the second wing plate is located below the first wing plate and is shorter and narrower than the first wing plate, and the second wing plates are located at two sides of the U-shaped groove.

6. The chassis end plate assembly of a railway vehicle according to claim 5, wherein a longitudinal wing plate is arranged on a top of the buffer beam.

7. The chassis end plate assembly of a railway vehicle according to claim 5, wherein the mounting hole comprises a first mounting hole above the first wing plate, and a second mounting hole and a third mounting hole which are both located below the first wing plate and at an outer side of the second wing plate.

8. The chassis end plate assembly of a railway vehicle according to claim 1, wherein the end plate and the buffer beam are each provided with an inner windshield mounting interface, and the end plate is further provided with an outer windshield mounting interface.

9. The chassis end plate assembly of a railway vehicle according to claim 1, wherein the bottom beam and the curved beam are hollow rectangular profiles, and on a side of each of the bottom beam and the curved beam abutting against the under-vehicle active device compartment, a vertical edge deflecting toward an interior of a vehicle body is formed.

10. A railway vehicle, comprising a vehicle body and a bogie, wherein an under-vehicle active device compartment of the vehicle body is provided with the chassis end plate assembly of a railway vehicle according to claim 1, and a part below the buffer beam of the end plate assembly is combined with the under-vehicle active device compartment to form an enclosed space.

* * * * *